United States Patent [19]

Schreckenberg

[11] 4,313,363

[45] Feb. 2, 1982

[54] DEVICE FOR FEEDING OF AMMUNITION FOR A TOP MOUNTED GUN

[75] Inventor: Klaus Schreckenberg, Vellmar, Fed. Rep. of Germany

[73] Assignee: Thyssen Industrie Aktiengesellschaft, Essen, Fed. Rep. of Germany

[21] Appl. No.: 47,901

[22] Filed: Jun. 12, 1979

[30] Foreign Application Priority Data

Jun. 15, 1978 [DE] Fed. Rep. of Germany ..... 2826136

[51] Int. Cl.[3] ..... F41F 9/06

[52] U.S. Cl. ..... 89/46

[58] Field of Search ..... 89/1.802, 1.804, 1.805, 89/45, 46, 47

[56] References Cited

U.S. PATENT DOCUMENTS

| | | | |
|---|---|---|---|
| 1,185,249 | 5/1916 | Seeberger | 89/46 |
| 2,972,934 | 2/1961 | Platt et al. | 89/46 |
| 3,584,532 | 6/1971 | Stoner et al. | 89/47 |

FOREIGN PATENT DOCUMENTS

| | | | |
|---|---|---|---|
| 144011 | 2/1954 | Sweden | 89/45 |

*Primary Examiner*—Stephen C. Bentley

*Attorney, Agent, or Firm*—Becker & Becker, Inc.

[57] ABSTRACT

A device for feeding of ammunition, particularly cartridges, by use of an elevator and tubular cartridge receiver for the ammunition, i.e. cartridges, especially for armored vehicles, from an ammunition magazine positioned below a platform. The platform is rotatable about a vertical axis relative to a top mounted gun with zero elevation and positioned on the platform. The elevator is secured at the underside of the platform and includes a tubular cartridge receiver associated with a spring-biased centering mechanism which extends into the free cross-sectional area of the cartridge receiver, and at least one spring-biased holder for the cartridges movable vertically relative to the longitudinal axis of the cartridge receiver. The cartridges, are stored vertically relative to the axis of the bore of the gun in the magazine therefor as well as is also being secured to the platform underside so that the same can be elevated to a point above the platform. The cartridge can then be brought into a position so as to be coaxially aligned with the bore of a gun barrel and the cartridge receiver serves simultaneously as the charging tube in which there is integrated a ram.

5 Claims, 3 Drawing Figures

DEVICE FOR FEEDING OF AMMUNITION FOR A TOP MOUNTED GUN

The present invention relates to a device, especially for armored vehicles, for feeding of ammunition by means of an elevator and tubular receivers for the ammunition, particularly cartridges from an ammunition magazine positioned below a platform which is rotatable about a vertical axis to a top mounted gun with zero elevation, which gun is positioned on the platform.

Armored vehicles serving as weapon carriers are required to be as compact as possible in order to provide a target as small as possible in attacks. On the other hand, despite the resultant reduced vehicle interior, in addition to the personnel and the drive components, the ammunition supply is to be provided under armor protection as deep within the vehicle as is feasible. This leads to particular problems during transport of ammunition or cartridges from the ammunition magazine to the gun, particularly when thin-walled and, thus, shock-sensitive cartridges or those having shells formed of non-metallic material, are handled, because a very protective feeding has to be carried out for this transport.

There is known an ammunition feeding device comprising an elevator for the ammunition having an ammunition receiver at its upper end which is vertically rotatable and horizontally pivotable. The ammunition receiver has a tubular holder means, in which the cartridge or piece of ammunition is transferred from the elevator into the ammunition receiver and from there into a loading device comprising a tube slit or split, in longitudinal direction. The cartridge is then introduced into the barrel of the gun by means of an additional device. In this device of the prior art; it is detrimental that the piece of ammunition is passed through several transfer stations along a transport path from the elevator to insertion into the gun barrel; thus the time and effort increase to a level not acceptable for the increased demands concerning rapid firing made of modern weaponry. Furthermore, because the ammunition receiver is positively secured on the platform and due to the loading device as well as the inserting device causing the silhouette or outline of the vehicle to be increased, this configuration is more readily detected as a target along the terrain.

It is an object of the invention to provide a device so that a simple and operationally safe as well as faster transport is possible, which can be carried out independently of the azimuth or bearing position of the gun such that no fixed superstructures are required on the rotatable platform.

This object and other objects and advantages of the invention will appear more clearly from the following specification in connection with the accompanying drawings, in which.

Figures 1, 2:
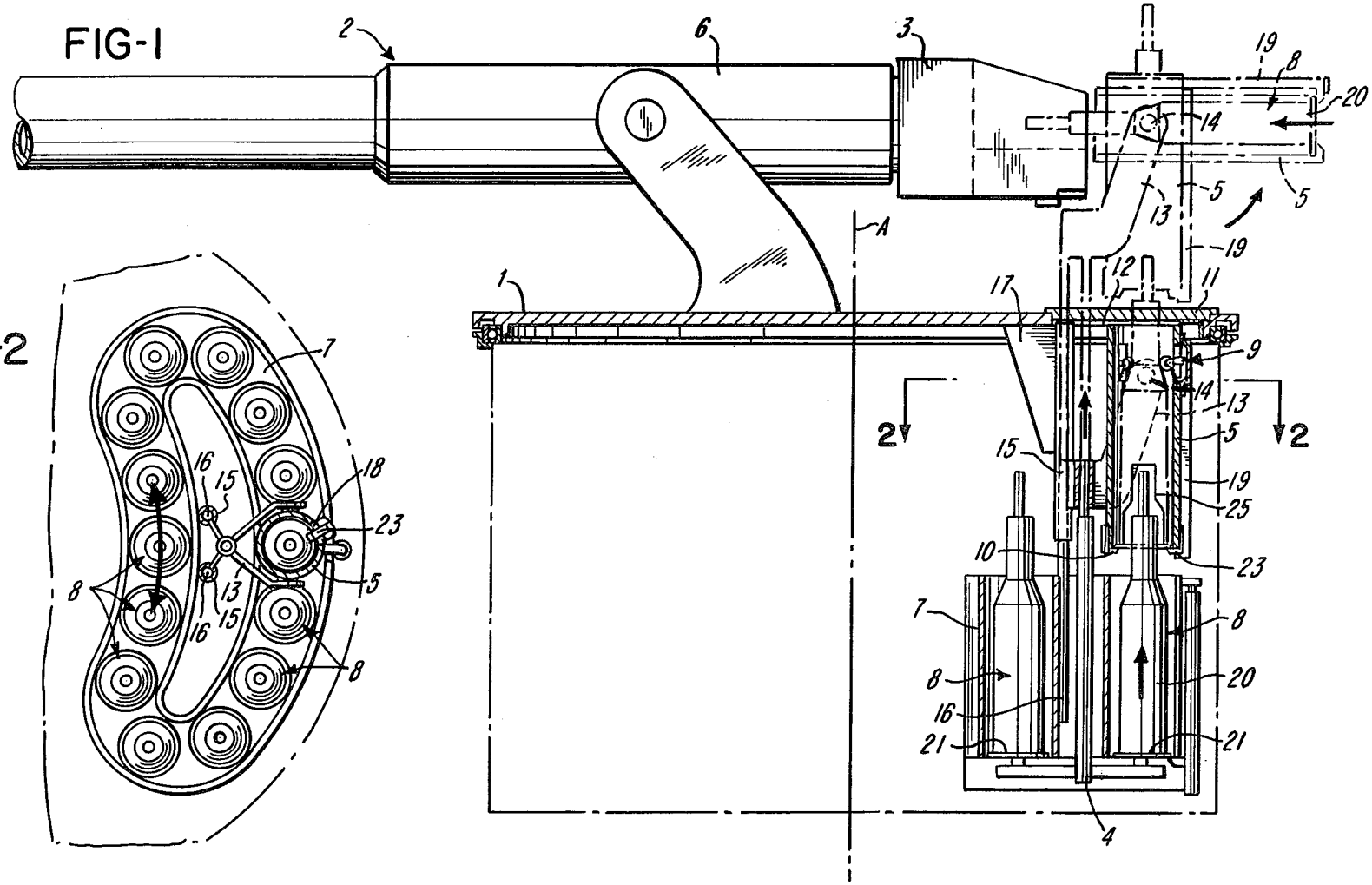
FIG. 1 is a side elevational view, partly in cross section, showing a rotatable platform with a top mounted gun and the feeding device in accordance with one embodiment of the invention wherein the elevator is indicated in two different positions.
FIG. 2 is a top plan view of a section along line 2—2 in FIG. 1.

The device is characterized primarily thereby that the elevator is secured at the underside of the platform and includes a tubular cartridge receiver which is associated with a spring biased centering means. The centering means extends into the free cross-sectional area of the cartridge receiver, and at least one spring-biased holder for the cartridged is movable vertically relative to the longitudinal axis of the cartridge receiver. The cartridges are stored vertically relative to the axis of the bore of the gun in the magazine therefor as well as also being secured to the platform underside so that the same can be elevated to a point above the platform. The cartridge can then be brought into a position to be coaxially aligned with the bore of the gun barrel and the cartridge receiver serves simultaneously as the charging tube in which there is integrated a ram.

The ammunition feeding device itself, provided as a unit operational per se, has the advantage that it can be installed later into an armored vehicle without considerable fitting thereof. Furthermore; the relative travel distances through which the pieces of ammunition have to be brought to the gun are reduced by the embodiment of this feeding device, without interpositioning of particular loading means.

In accordance with a preferred embodiment of the invention, the centering means for the cartridges receiver comprises of at least three elements such as pawls, latches or rollers, or the like, uniformly distributed about the free cross-sectional area of the cartridge receiver. These elements are arranged in that section of the cartridge receiver closer to the cartridge exit and serve simultaneously as a guide for the cartridge being moved therethrough but, nevertheless, permit free passage for the bottom flange of a cartridge.

A further embodiment of the invention provides that the cartridge receiver includes at its cartridge receiving end diametrically opposed apertures which correspond to the forward cartridge part, forward in the direction of shooting.

In accordance with another embodiment of the invention, the cartridge holder in the cartridge receiver comprises a deflecting arm, for example a plate or flat spring, with a nose positioned at the free end of the arm. The nose is adapted to operatively engage the bottom flange of a cartridge. The arm can be moved into an opening position when a cartridge is moved into the cartridge receiver and, after the insertion of the cartridge it can be brought into its initial position (operating position). This arm is provided at that end of the cartridge receiver which is intended for the receipt of the cartridge.

In accordance with a further embodiment, the nose of the ram arranged in the cartridge receiver forms at least part of the cartridge holder. This nose is movable out of the free cross-sectional area of the cartridge receiver, for the supply of cartridges to the cartridge receiver due to the action of a follow-up control or remote control system.

Referring now particularly to the drawings in detail, there is shown a platform 1 rotatable about vertical axis "A" and provided within an armor cover (vehicle or bunker) as well as being provided with a top mounted, vertically adjustable gun 2 at elevation zero.

Below the breech plate 3 of gun 2 at the underside of the platform 1, an ammunition elevator or conveyor 4 is rigidly secured and has a tubular cartridge receiver 5 therewith including a longitudinal axis thereof which extends perpendicular to the vertical plane of the axis of bore of the gun barrel 6 (FIG. 1). Furthermore an ammunition magazine 7 is provided at the underside of platform 1 with the cartridges 8 being stored vertically upstandingly. The cartridges can be moved by means of a remote or follow-up control means, in sequence following each other, into a ready position below the elevator 4. Each of the thus presented cartridges is eventually transferred, by means of a lifting device, not shown, out of the magazine 7 into the tubular cartridge receiver 5. The tubular cartridge receiver 5 includes a centering mechanism generally designated by the numeral 9 and a holder 10 for the cartridge belonging therewith. Subsequently, the cartridge receiver 5, with the cartridge received therein, is moved upwardly whereby a pivotable cover 11 is movable to clear an opening 12 in the platform 1 for a short period of time so that the cartridge receiver can rise to a position above the platform 1. The cartridge receiver 5 is journalled at an upwardly-bent, forked carrying arm 13 of the elevator or conveyor 4. This conveyor may be hydraulically actuated, and is also connected thereto by way of a pivoting arrangement 14, also hydraulically actuated. So that it is guided for its up and down movements in a precise manner, the arm 13 can be provided at the ends directed away from the bifurcation with corresponding elements, such as rods 16, guided in tubes 15.

As soon as the elevator or conveyor 4 reaches its uppermost position limited by an abutment 17 arranged at the underside of the platform 1, this uppermost position being indicated in dot-dash outline in FIG. 1, the tubular cartridge receiver 5 is swung into the loading position by means of the pivoting arrangement 14 and in loading position its longitudinal axis is coaxial with the rearwardly extended axis of bore of the gun barrel 6. During the upward motion of the cartridge receiver 5, or during its swinging into the loading position, the magazine 7 is further rotated, while actuating the remote or follow-up control system, either in clockwise or counter-clockwise sense, so that the next cartridge is at ready to be fed into the cartridge receiver. As soon as the tubular cartridge receiver 5 reaches its loading position and is in contact with an abutment, not shown, at the breech plate 3 of gun 2, a ram 19 arranged in a longitudinal aperture 18 of the cartridge receiver 5 is moved by means of drive means, not here described in greater detail. The drive means are controlled by the aforementioned remote or follow-up control system and the pertaining cartridge is moved out of the cartridge receiver 5 now serving as a loading tube into the breech plate 3 of gun 2.

Subsequently, ram 19 is returned to its starting position in the cartridge receiver 5. When the cartridge receiver 5 has been swung again to its vertical position and it is in the downward or subsequent upward movement, the shell case 20 of the fired cartridge is ejected.

Figure 3:
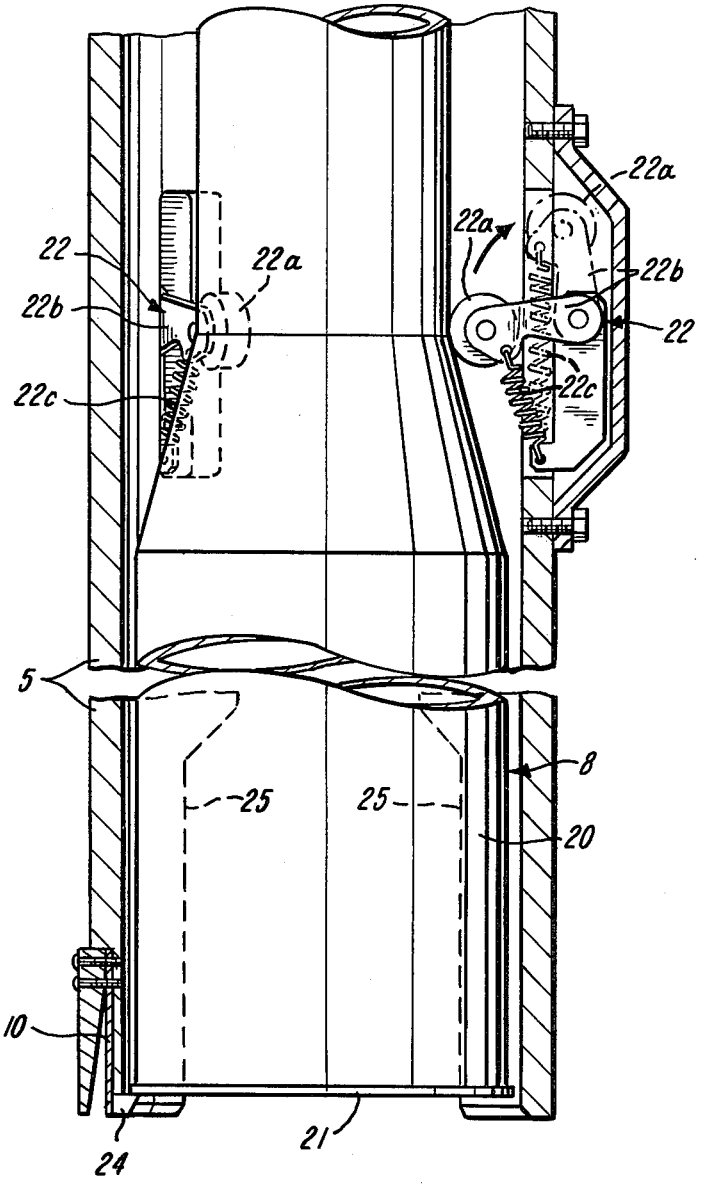
FIG. 3 shows a cartridge holder in longitudinal section and drawn to a larger scale.

Since the bottom flange 21 of a cartridge 8 has a greater diameter than the shell 20 and the round of ammunition, for the purpose of centering of the cartridge so that it will not be inclined or skewed in the cartridge receiver 5, several supporting elements 22 are provided extending into the free cross-sectional area of the tubular cartridge receiver 5, uniformly distributed and resiliently supporting the cartridge. These supporting elements 22 collectively forming the centering mechanism 9 also support the cartridge approximately at the region of its center of gravity, preferably, however, in the transition region at the conical shell shoulder of the round of ammunition, as indicated in FIG. 3. For the forward motion of the cartridge in the cartridge receiver 5 to be inserted in the breech plate 3 of the gun 2 it is, however, necessary that the elements 22 can be retracted through such a distance that the bottom flange 21 of a cartridge can pass unhindered thereat. In the embodiment of an element 22 indicated in FIG. 3, the elements which compensate for the difference in the radii between cartridge 8 and the free cross-sectional area or width of the tubular cartridge receiver 5, each comprise a centering roll **22*a* which is mounted on a swing lever 22*b*, belonging therewith. A spring 22*c* serves to retract the lever 22*b* to the position shown in solid lines in FIG. 3. During transport thereof and particularly during tilting into the loading position, the cartridge 8 centered now in the cartridge receiver 5 is fixed by the holder 10 which, according to FIG. 3, comprises a deflecting arm, for example, a flat or plate spring having a nose 24 at its free end. The nose 24 is adapted to operatively engage the bottom flange 21 of a cartridge 8. This resiliently biased nose 24 extends, in rest position, also into the clear opening or width of the tubular cartridge receiver 5 and is moved into its opened position under the influence of the cartridge which is inserted into the cartridge receiver 5. The cartridge shell 20, thus, slides along nose 24 until the nose 24 engages behind the bottom flange 21 of a cartridge 8** and thus reaching its operating position.

The holder indicated in FIGS. 1 and 3 for the cartridge in the cartridge receiver 5 can be dispensed with when the nose 23 of the ram 19 provided in the cartridge receiver 5 is formed a holder according to FIG. 2.

For the supply of cartridges to the cartridge receiver 5, the nose 23 of ram 19 is moved or returned due to a corresponding action of the remote or follow-up control, not shown, for a short period of time, out of the free cross-sectional area of the cartridge receiver 5. In order to provide a distance as short as possible between the magazine 7 and the platform 1, the tubular cartridge receiver 5 is provided with diametrically positioned apertures 25 at its end serving to receive the cartridges. The apertures 25 correspond to the forward part of a cartridge 8 considered in the direction of shooting. This permits that, despite the overlap of the length of a cartridge by the cartridge receiver, the cartridges which are provided upstandingly in the magazine 7 can move, on rotation of the magazine 7, unhindered transversely with respect to the cartridge receiver 5.

The present invention is, of course, in no way restricted to the specific disclosure of the specification and drawings, but also encompasses any modifications within the scope of the appended claims.

I claim:

1. A device for feeding ammunition from a vehicle interior to a weapon, gun or cannon including particularly transporting of cartridges usable with armored vehicles having a gun mounted on top of a rotatable platform thereof, said device in combination as a single unit and structurally integrated comprising:

elevator means operatively connectible at the underside of said platform for receiving a cartridge from a magazine provided below said platform;

cartridge receiving means operatively connectible to said elevator means for receiving a cartridge therefrom, said receiving means including;

(a) a tubular cartridge receiver, said tubular cartridge receiver being connectible to and movable within said elevator means for retaining a cartridge during transport thereof from said magazine to a point above said platform, said cartridge receiver with said cartridge therein also being movable from said point above said platform to a position coaxial with the bore of said gun belonging therewith;

(b) spring biased means for centering a cartridge in said tubular cartridge receiver, said centering means being adapted to extend into the free cross-sectional area of said cartridge receiver;

(c) at least one spring biased holder means operatively connectible to said tubular cartridge receiver for holding a cartridge belonging therewith in said cartridge receiver, said at least one holder means being adapted to be movable perpendicular to the longitudinal axis of said cartridge receiver;

ram means in said cartridge receiver for moving a cartridge into said bore of said gun, said cartridge recevier serving as a charging tube for said gun; and means for effecting pivotable movement of said cartridge receiver, said cartridge receiver including diametrically opposed apertures corresponding in shape to the forward portion of a cartridge for allowing a cartridge to be received in said cartridge receiving means.

2. A device in combination according to claim 1, wherein said spring biased means for centering a cartridge in said tubular cartridge receiver includes at least three elements, said elements being evenly distributed about the free cross-sectional area of said cartridge receiver at that portion of said cartridge receiver which is closest to the cartridge exit thereof, said elements being spring biased to guide a cartridge and yet permit free passage of a cartridge belonging therewith through said cartridge receiver.

3. A device in combination according to claim 1, wherein said spring biased holder means includes a deflecting arm mountable to said cartridge receiver at that end of said cartridge receiver at which a cartridge enters, said arm having a nose-like projection at its free end for operatively engaging a flange projection of a cartridge therewith, said nose-like projection being movable out of the path of a cartridge therewith being introduced into said cartridge receiver and being returnable to operatively engage a flange projection of a cartridge therewith upon complete introduction of a cartridge into said cartridge receiver.

4. A device in combination according to claim 3, wherein said deflecting arm includes a leaf spring.

5. A device in combination according to claim 1, wherein said ram means includes a nose-like projection, said ram means being adapted to act as said holder means, whereby for the introduction of a cartridge into said cartridge receiver said nose-like projection is movable out of the path of a cartridge belonging therewith being introduced into said cartridge receiver.

* * * * *